United States Patent [19]

Gross et al.

[11] 4,068,329

[45] Jan. 17, 1978

[54] MODULAR BOX SPRING ASSEMBLY

[75] Inventors: Nathan Gross, Pittsburgh, Pa.; William B. Friddle, Louisville, Ky.

[73] Assignee: Restonic Corporation, Oak Brook, Ill.

[21] Appl. No.: 729,270

[22] Filed: Oct. 4, 1976

[51] Int. Cl.[2] ..... A47C 23/02

[52] U.S. Cl. ..... 5/255; 5/263; 5/260

[58] Field of Search ..... 5/247, 252, 255–257, 5/263–266, 282 R, 305; 52/376, 732

[56] References Cited

U.S. PATENT DOCUMENTS

| | | | |
|---|---|---|---|
| 1,909,243 | 5/1933 | Adamy | 52/376 |
| 2,097,976 | 11/1937 | Haberstump | 5/264 R |
| 3,833,948 | 9/1974 | Surletta et al. | 5/255 |
| 4,000,531 | 1/1977 | Inman | 5/351 |

*Primary Examiner*—Casmir A. Nunberg

*Attorney, Agent, or Firm*—Haight, Hofeldt, Davis & Jambor

[57] ABSTRACT

A box spring assembly having a rectangular frame mounting a plurality of lateral support slats, formed wire torsion springs affixed to said slats and a metal grid interconnecting said springs. To minimize sag resulting from body weight, the support slats adjacent the lateral center line of the frame are first reinforced with U-shaped metallic bars which rest the wooden slats. In addition, the number or density of lateral slats adjacent this center line are increased leaving a lower density of slats adjacent the head and foot ends of the assembly. This arrangement of lateral slats permits reorientation of the formed wire spring units which further results in greater lateral stability of the box spring unit. The assembly is then completed by adding one or more insulating pads for cushioning and a fabric cover.

5 Claims, 4 Drawing Figures

MODULAR BOX SPRING ASSEMBLY

BACKGROUND OF THE INVENTION

This invention relates to a box spring assembly for a bed. More particularly, it relates to a box spring assembly utilizing formed wire torsion bar springs.

DESCRIPTION OF THE PRIOR ART

Formed wire torsion springs have been long utilized in the seat and bedding industry. Illustrative of this prior art are the following patents:

No. — Invention — Issue Date 902,179 (U.K.) — Stubnitz Green Corp. — July 25, 1962

3,286,281 — Slominski — November 22, 1966

3,833,948 — Surletta — September 10, 1974

The prior art employment of these springs thus use the conventional rectangular base frame across which is placed wooden or metal lateral supporting slats. Affixed to and mounted upon these slats are upstanding springs whose number and orientation suggests little more than a substitution of this type of spring for coil springs. Then the tops of these springs are interconnected with a latticework or metal grid while a fabric cover then envelopes the units thus assembled.

While this construction has been favorably accepted within the industry, the optimum advantages of formed wire springs have not been realized. To the contrary, such springs, at best, seem to have been utilized as a mere substitute for coil springs with little regard being given to that cooperative relationship between the various elements which could otherwise maximize the contribution of such springs.

SUMMARY OF THE INVENTION

The present invention is primarily directed to a new cooperative arrangement among the conventional elements of a box spring assembly. This invention includes a rectangular frame across which is affixed lateral support slats in such a position and of a construction which maximizes the sag reduction at the center of the bed. First, these slats are concentrated near the lateral center line of the frame. Second, the adjacent two slats on opposite sides of this center line are of a novel composite structure having reinforced metallic U-shaped nesting supports. Finally, affixed upon this non-uniform spacing of later supports are formed wire torsion springs whose number or density are concentrated along this lateral center line. Further, this arrangement of lateral supports not only permits this concentration of springs near the center of the bed, but further permits their orientation at right angles to one another for the purpose of enhancing the lateral stability of the metal latticework affixed to the top of the springs.

Accordingly, it is an object of our invention to provide a box spring having a novel cooperative arrangement which minimizes sag or bending deflection of the box spring assembly. In addition, it is an object of our invention to provide at least two composite lateral supporting slats which further minimizes sag reduction without substantially increasing the material or labor costs of the assembly. Moreover, this assembly is designed to maximize the advantages available from formed wire springs, permitting both their concentration in the areas of maximum load and an orientation at right angles to one another to maximize lateral rigidity of the top of the unit.

DESCRIPTION OF THE DRAWINGS

The manner in which the above and other objects of this invention are attained will be described in conjunction with the following drawings in which.

DETAILED DESCRIPTION

Figure 1:
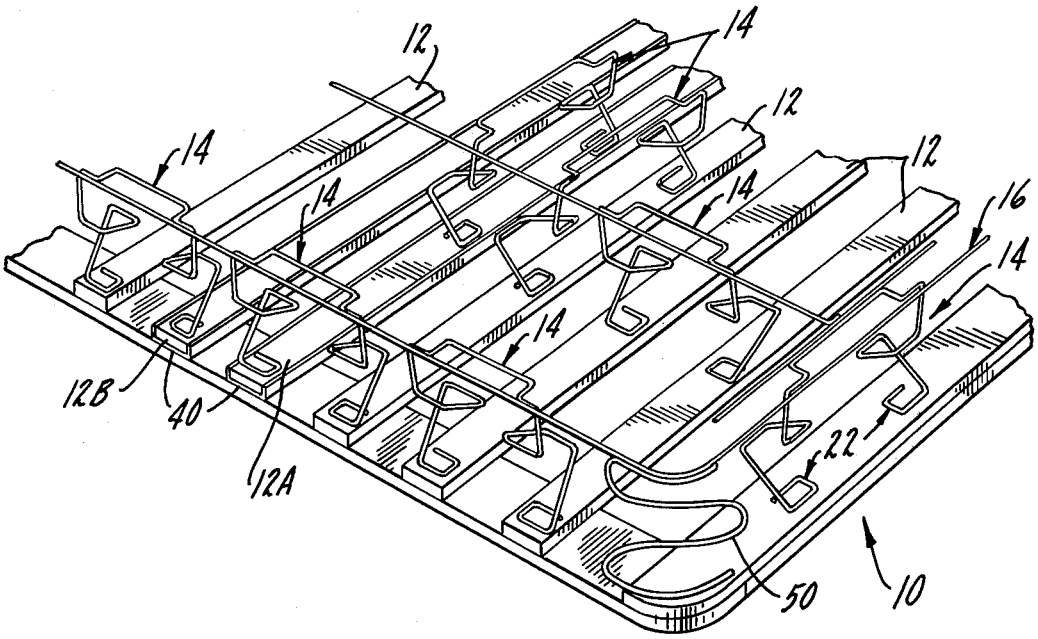
FIG. 1 is a perspective view of a portion of the box spring assembly of our invention.
Figure 2:
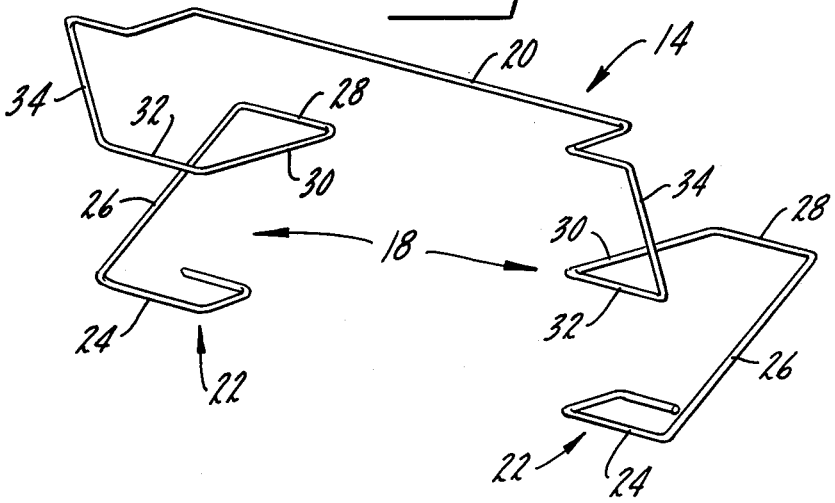
FIG. 2 is a perspective view of a formed wire torsion bar spring utilized in the box spring assembly.

As depicted in FIG. 1, the box spring assembly of our invention includes a rectangular frame 10 upon which is mounted laterally extending supporting slats 12. Affixed to these slats 12 are formed wire torsion springs 14 which may be interconnected at the top by a latticework or metal grid 16 (See FIG. 3). After assembly, these elements are enclosed within an attractive fabric cover to complete the unit. These mentioned elements are conventional and commercially available. Yet, prior to describing our contribution, the structure of the torsion springs should be understood. These springs, commercially available under part no. MV 486-1 from the No-Sag Spring Division of Lear Siegler, Inc. of Berkley, Michigan, are of one basic design as depicted in FIG. 2. Each spring has two body portions 18 interconnected by a primary torsion bar 20. These body portions 18 each include a base 22 which is to be affixed to the slats 12, the base including a secondary torsion bar 24. From this bar 24 extends a lever arm 26 which joins an intermediate torsion bar 28 having another inclined lever arm 30 extending upward to define a "fishmouth section." This lever arm then merges into a second intermediate bar 32 which is further connected by another lever arm 34 to the primary torsion bar 20 by coplanar offsets which facilitate attachment to the metal grid 16.

Figure 4:
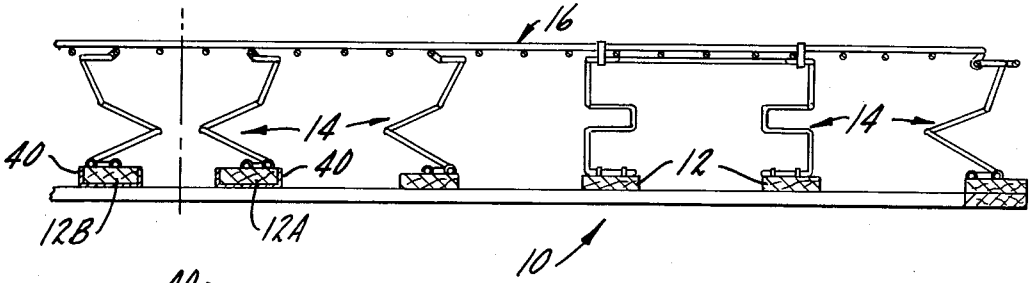
FIG. 4 is a sectional view of our invention taken along line 4—4 of FIG. 3.
Figure 3:
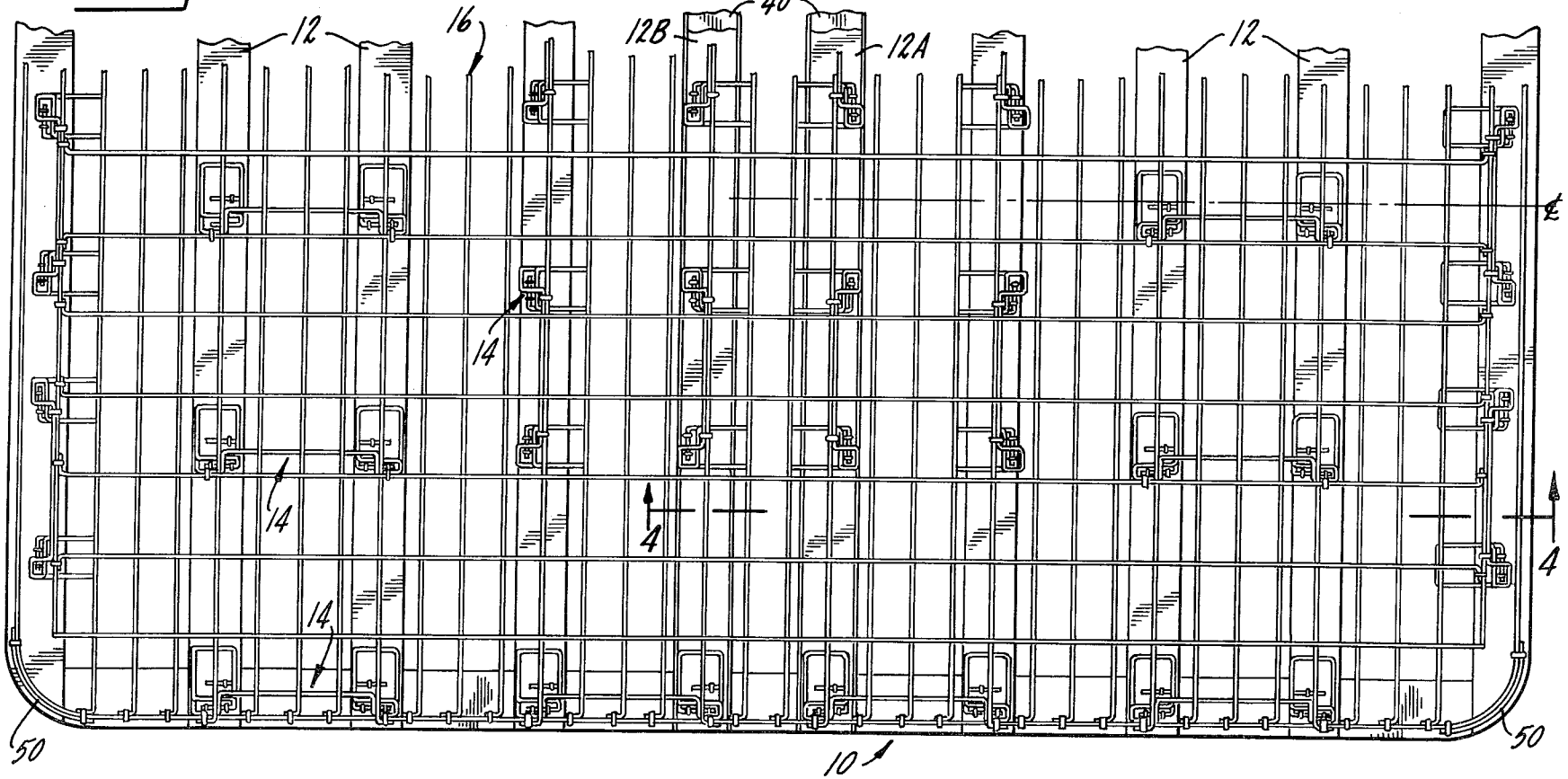
FIG. 3 is a plan view of a portion of our invention that portion above the longitudinal center line being a mirror image of the lower portion.

Against this background, and with reference to FIGS. 3 and 4, the details of our invention can be understood. First, the rectangular frame 10 is assembled and upon this frame is positioned the laterally extending supporting slats 12. However, to maximize sag reduction and bending deflections, these slats are concentrated towards the lateral center line of the frame. Thus, FIGS. 3 and 4, disclose that the slats in the center are closer to one another than those adjacent the head or foot ends of the box spring assembly. Such increases resistance to bending in an area where the body weight of the individual is concentrated. However, to further-maximize this resistance without excessive cost, the center lateral slats 12 A and 12 B are formed of composite materials. Both include the conventional wood slat 12. In addition, however, these two slats are nested in preferably a thin gauge U-shaped metal reinforcing members 40. These metal members, encapsulating the wooden slats, extend across the frame 10 and are affixed thereto by nails or staples extending downward through the slats 12 A and 12 B, the members 40 and into the frames. Being of thin gauge these members do not hinder assembly. Moreover, members 40 offer additional resistance to bending deflection without any substantial increase in total slat thickness which would otherwise effect bed height and conflict with industry standards.

Finally, their ends being fixed by nailing, the composite slat 12 A or 12 B does not flex as a free beam, nor is the metal as susceptable as wood to taking a "set" under body weight which would otherwise result in a loss of resilience. Finally, by the use of a U-shape, the upward extending flanges, reinforced by the wood slat add further bending resistance. With this construction, the maximum body weight load is resisted by both the placement and construction of the laterally supporting slats.

Moreover, this placement of the slats permits optimum utilization of the formed wire spring units 14. Further reference to FIG. 3 discloses a total of ten lateral slats - this number including the ends of the rectangular frame. The center four slats, two of which have closer spacing, each carry a series of complete formed wire springs 14 having their primary torsion bars perpendicular to the longitudinal axis of the assembly. The next two slats on each side of the center four, however, do not carry a complete spring unit. Instead, the formed wire units 14 extend across these slats, having a base 22 of each spring 14 mounted on adjacent slats with their primary torsion bar 20 being parallel to the longitudinal axis of the assembly. This orientation of some spring units being perpendicular to others maximizes the lateral resistance of the metal grid 16 to lateral forces acting both perpendicular and parallel to the longitudinal axis of the bed. In addition to this enhanced lateral stability, this arrangement, permitted by slat spacing, increases the number or density of spring units 14 underneath the greatest weight concentration of the sleeper. The remaining spring units about the periphery of the bed are mounted with their primary torsion bar 20 parallel to the frame.

Completing the bed assembly are conventional corner springs 50 also available from the No-Sag Division of Lear Siegler, Inc. Being curved in their verticle plane, they round off the corners of the bed.

In manufacture, the frame 10 is first assembled with the lateral slats 12 being affixed in accord with the spacing depicted in FIGS. 3 and 4, then, the bases 24 of the formed wire springs 14 are stapled or clipped to the slats in the orientation depicted in these figures. After attaching the corner springs 50, the metal grid 16 is placed on the top of the springs and clipped to the primary torsion bars 20. Subsequently, the conventional padding and fabric covers are added to complete the unit.

In accord with our invention, it is preferred to utilize only a single size formed wire unit. Yet, the desired spacing and density is obtained by slat spacing and orientation. Moreover, the bending resistance of such slat and spring spacing and orientation, is further enhanced by the composite slat construction of slats 12 A and 12 B. Obviously, some of the advantages of our invention can be achieved without use of each of the described structural improvements, and minor modifications of the structure may permit some or all of the advantages to be obtained.

We claim:

1. A box spring assembly comprising:

a. a frame;

b. a plurality of laterally supporting slats extending across said frame; said slats having a closer spacing adjacent the lateral center line of said frame with the slats disposed immediately adjacent said lateral center line having a metallic U-shaped member nesting same;

c. a plurality of elongated formed wire torsion springs having a primary torsion bar interconnecting two body portions which are affixed to said slats, said springs adjacent the lateral center line of said assembly having their primary torsion bar perpendicular to said slats, the density of said springs adjacent the lateral center line being higher than that of the springs displaced away from said center line;

d. a metal latticework mounted on said springs and affixed thereto; and e. a fabric covering said unit.

2. In a box spring unit having a frame, lateral slats mounting spring units and protective cover, the improvement comprising:

a. a higher density of lateral supporting slats adjacent the lateral center line of said assembly, at least two of said slats adjacent to lateral center line being nested in a reinforced U-shaped metal member;

b. a higher density of spring units adjacent said lateral center line of said assembly said spring units comprising formed wire torsion bars having two body portions interconnected by a primary torsion bar, the springs being oriented such that the primary torsion bars of the spring adjacent the lateral center line are parallel to the supporting slats, while those displaced from said lateral center line are perpendicular to the slats; and c. the density of said spring units adjacent said lateral center line is greater than the density of those displaced from said center line.

3. A box spring assembly comprising:

a. a rectangular frame;

b. lateral slats extending across said frame;

c. formed wire torsion bar springs mounted on said slats, having two body portions interconnected at a primary torsion bar defining a longitudinal axis of said spring said longitudinal axis of the springs adjacent the lateral center line being parallel to the slats and the longitudinal axis of the springs displaced from the center line being perpendicular to the slats; and d. the lateral slats adjacent the lateral center line having a closer spacing than the slats adjacent to ends of the frame.

4. An apparatus as recited in claim 3 in which the density of the formed wire springs is higher adjacent the lateral center line of the frame than the density of said slats adjacent to ends of the frame.

5. An apparatus as recited in claim 4 in which the slats adjacent the lateral center line of the frame are reinforced with U-shaped metal channels.

* * * * *